US005531561A

United States Patent [19]

Rae et al.

[11] Patent Number: 5,531,561

[45] Date of Patent: Jul. 2, 1996

[54] LOADER PARKING STAND SYSTEM

[75] Inventors: Rory Rae, Port Colborne; Ken K. Oka, St. Catharines; Gordon D. Hubbard, Beamsville; Frank F. Rocco, Welland; David W. Bratt, Fenwick; Dean R. Chalmers, Waterloo; Ron M. Hind, Stevensville, all of Canada

[73] Assignee: Deere & Company, Moline, Ill.

[21] Appl. No.: 354,298

[22] Filed: Dec. 13, 1994

[51] Int. Cl.[6] ..... E02F 3/00

[52] U.S. Cl. ..... 414/686

[58] Field of Search ..... 414/686, 722; 280/763; 172/274; 212/301, 302, 306

[56] References Cited

U.S. PATENT DOCUMENTS 4,264,264 4/1981 McMillan et al. .

4,337,015 6/1982 Friesen et al. .

4,347,031 8/1982 Friesen et al. .

FOREIGN PATENT DOCUMENTS 1121146 7/1968 United Kingdom ..... 414/686

2110643 6/1983 United Kingdom ..... 414/686

*Primary Examiner*—Donald W. Underwood

[57] ABSTRACT

A loader parking stand system includes a pair of stands mounted to the torque tube interconnecting a pair of boom arms of the loader. The connection of each stand to the torque tube is effected by inserting a connecting pin, defining the upper end of the stand, into a cylindrical receptacle projecting upwardly into and being welded to the torque tube, the receptacle being nearly vertical when the loader is disposed in an attitude for being parked. Each stand includes a latch mechanism located entirely inside the torque tube and being manually operable for selectively releasing the stand for permitting it to be swivelled through 180° between its stored and park positions.

9 Claims, 2 Drawing Sheets

LOADER PARKING STAND SYSTEM

BACKGROUND OF THE INVENTION

The present invention relates to tractor-mounted front end loaders and more particularly relates to a parking stand system for supporting such a loader when it is removed from the tractor.

Different types of parking stand systems are used for different loader configurations. For example, in one known loader configuration the support for the loader boom includes a pair of upright mast posts adapted for connection to opposite sides of a tractor and a u-shaped brace having legs rigidly fixed to the mast posts and having forward ends adapted for connection to a forward location of the tractor frame. This loader configuration uses a parking stand system which is incorporated in the u-shaped brace so as to be lowered, by tilting the masts after their disconnection, or by pivoting them relative to the brace, into contact with the ground to cooperate with the loader bucket in supporting the loader when it is disconnected from the tractor.

Another known loader configuration uses the mast posts alone to support the loader boom on the tractor. The parking stand system for loaders of this configuration include a pair of stands which are connected to opposite sides of the loader boom at locations which, when considered with the loader in a lowered position with the bucket on the ground, are spaced rearwardly and upwardly from the bucket at the forward end of the boom. These stands are selectively movable between stored and park positions.

The parking stand system of the instant invention is of the type for use with loaders configured like the last mentioned loaders. Exemplary parking stand systems of this type are disclosed in U.S. Pat. No. 4,264,264 granted to McMillan et al on 28 Apr. 1981; U.S. Pat. No. 4,337,015 granted to Friesen et al on 29 Jun. 1982; and U.S. Pat. No. 4,347,031 granted to Friesen et al on 31 Aug. 1982.

These known parking stand systems suffer from one or more of the drawbacks of not being adaptable for use with various sized loaders, of decreasing tractor tire clearance, of being awkward and heavy to manipulate between stored and park positions and of having latch hardware which is exposed to the elements resulting in latch components becoming corroded thus making it difficult to release the stands of the system for movement between stored and park positions.

SUMMARY OF THE INVENTION

According to the present invention there is provided an improved parking stand system for a tractor-mounted front end loader.

An object of the invention is to provide a parking stand system including a pair of stands of relatively simple design which are mounted to the loader boom in such a way as to be easy for an operator to use.

A more specific object of the invention is to provide a parking stand system for use with a loader boom of the type including a torque tube interconnecting opposite arms of the boom, the system including a pair of stands each having an upper end rotatably coupled to the torque tube, at a location adjacent one of the arms of the loader boom, in such a way that the stand is moveable between stored and park positions without needing to lift the stand.

Yet another specific object of the invention is to provide a pair of stands mounted to a loader boom torque tube, as set forth in the immediately preceding object, wherein a latch mechanism for selectively releasably securing each stand in either its stored or park position is located within the torque tube.

A further object of the invention is to provide a pair of stands, as set forth in the preceding objects, which are length-adjustable so that the stands are adaptable for use with loaders of different sizes.

These and other objects will become apparent from reading the ensuing description together with the appended drawings.

DESCRIPTION OF THE PREFERRED EMBODIMENTS

Preliminarily, it is to be noted that while some components may be described as occurring in pairs only one of each pair may be shown. It is to be understood that the unshown component is either identical to or a mirror image of that component shown.

Figure 1:
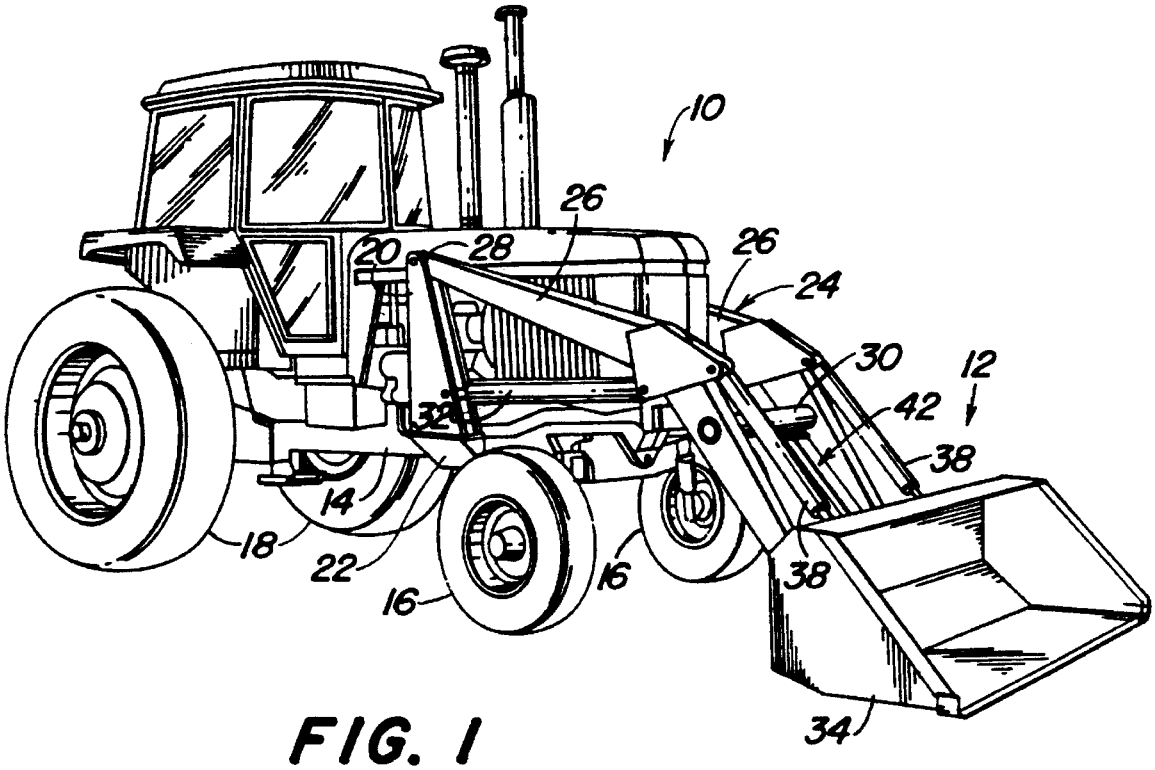
FIG. 1 is a right front perspective view of a tractor to which a front-end loader, embodying the parking stand system of the present invention, is attached.
Figure 2:
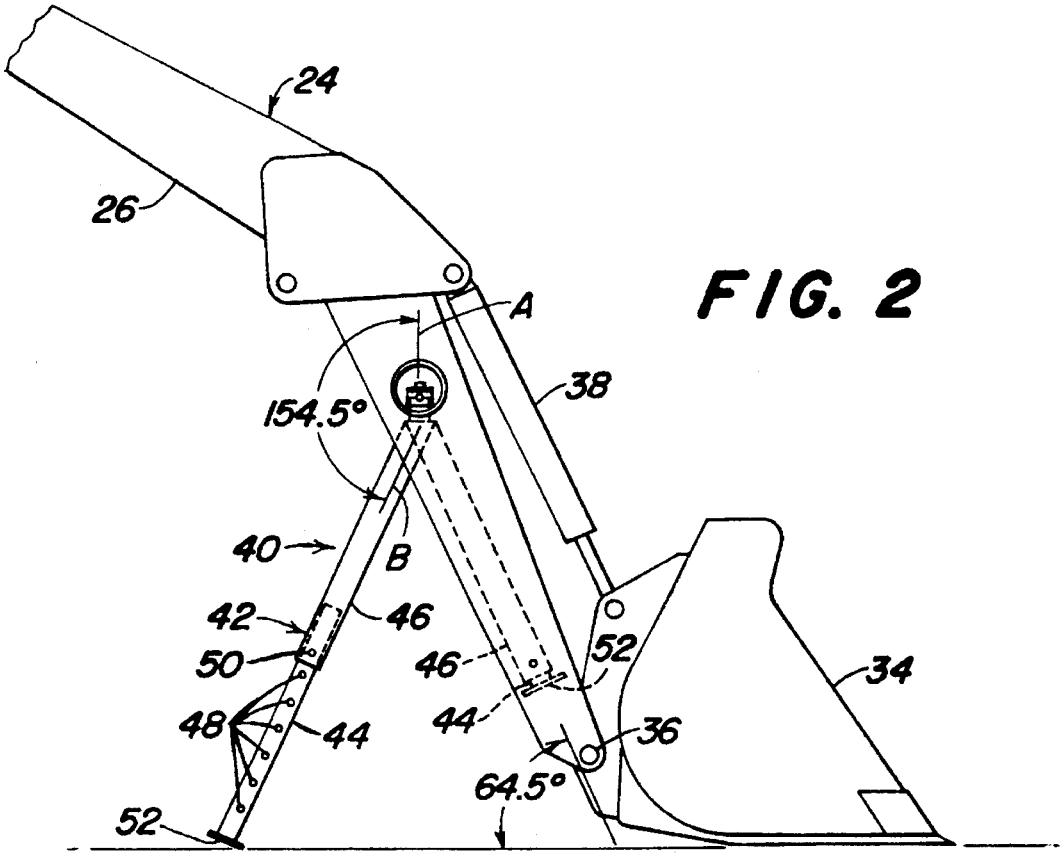
FIG. 2 is a right side elevational view of the loader shown dismounted from the tractor, with the stands being shown in a dashed line stored position.

Referring now to FIG. 1, therein is shown a tractor 10 having a front-end loader 12 mounted thereon. Specifically, the tractor 10 includes a fore-and-aft extending main frame 14 supported on pair of front steerable wheels 16 and on a pair of rear drive wheels 18. The loader 12 includes a pair of upright mast posts 20 respectively mounted to a pair of support frames 22 bolted to opposite sides of the main frame 14. The loader 12 further includes a boom 24 comprising a pair of transversely spaced, fore-and-aft extending, parallel arms 26 having their rear ends respectively pivotally mounted to the tops of the pair of mast posts 20 by a pair of connection pins 28. A horizontal torque tube 30 unifies or joins the arms 26 at a location which, when considering the loader in its lowered position shown in FIG. 1, is spaced forwardly of the tractor 10. Connected between each post 20 and the arm 26 that is connected thereto is a hydraulic boom lift cylinder 32 which operates to raise and lower the boom 24 about the axis defined by the connection pins 28. Referring now also to FIG. 2, it can be seen that a bucket 34 is pivotally coupled to the forward ends of the arms 26 by a pair of pins 36 and that a hydraulic bucket tilt cylinder 38 is connected between each arm 26 and the bucket 34. Up to this point the description is that of a conventional loader.

The loader 12 further includes a parking stand system 40 which is mounted to the boom 24. The parking stand system 40 includes a pair of identical stands 42 that are respectively mounted to the torque tube 30 at locations adjacent the inner sides of the arms 26. Specifically, referring now also to FIGS. 3 and 4, it can be seen that each stand 42 includes a length-adjustable main leg portion comprising an inner tube 44 of square cross section telescopically received within a complimentary shaped outer tube 46, with the inner tube 44 having a series of adjustment holes 48 spaced along its length and registrable with a cross hole 50 provided in the outer tube 46. A latch pin (not shown) is inserted through the aligned holes 48 and 50 to fix the tubes 44 and 46 relative to each other for thus establishing a desired length of the stand, this length depending on the configuration of the loader with which the stand is associated. A foot 52 is defined by a plate welded to the bottom of the inner tube 44. As can best be seen in FIGS. 3 and 4, a cap 54 is defined by a plate welded to the top of the outer tube 46 and welded to the cap is a cylindrical mounting pin 56 having an axis A which, together with a longitudinal axis B of the tubes 44 and 46, defines an included angle of about 154½°. The top portion of the pin 56 is reduced in diameter so as to form a boss 58 having a purpose explained below. When considering the loader 12 in its lowered position, as shown in FIGS. 1 and 2, a cylindrical stand mounting receptacle or bushing 60 (FIGS. 3 and 4) projects substantially vertically into and is welded to the torque tube 30 at each of a pair of bottom locations respectively located adjacent the insides of the arms 26. While these are the preferred locations for the mounting receptacles 60, for a reason which will become apparent from the following description, at least part of the objects of the invention would be achieved by welding the receptacles 60 to other locations of the boom 24 such as directly to inside surface locations of the arms 26. Received for rotation in, and projecting upwardly beyond the top of, each receptacle 60 is the mounting pin 56 of one of the pair of stands 42. It is important to note that the included angle defined by each of the arms 26 and the ground is about 64½° the complement of the included angle defined by the mounting pin 56 and the longitudinal axis of the main leg portion of the stand 42 defined by the tubes 44 and 46, so that the main leg portion of each of the stands 42 is disposed alongside the adjacent arm 26 when the stand is in its stored position, as shown in dashed lines in FIG. 2, and is angled upwardly and forwardly from the ground at about 64½° when the stand is in its park position, as shown in FIG. 2. Thus, when stored, the stands 42 do not diminish in any way the working clearance between the boom 24 and the steerable front wheels 16.

For releasably retaining the stands 42 in either their respective stored or park positions, each of the stands 42 includes a latch mechanism 62 located entirely within the torque tube 30.

Figure 3:
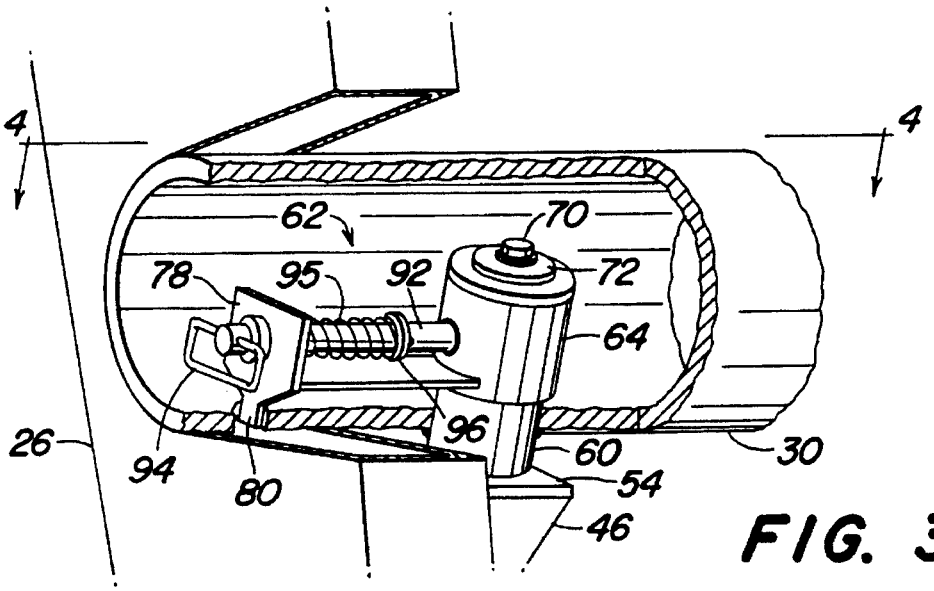
FIG. 3 is a right front perspective view, with parts broken away, of the joint between the right-hand loader arm and torque tube and the connection of the right-hand stand with the torque tube.
Figure 4:
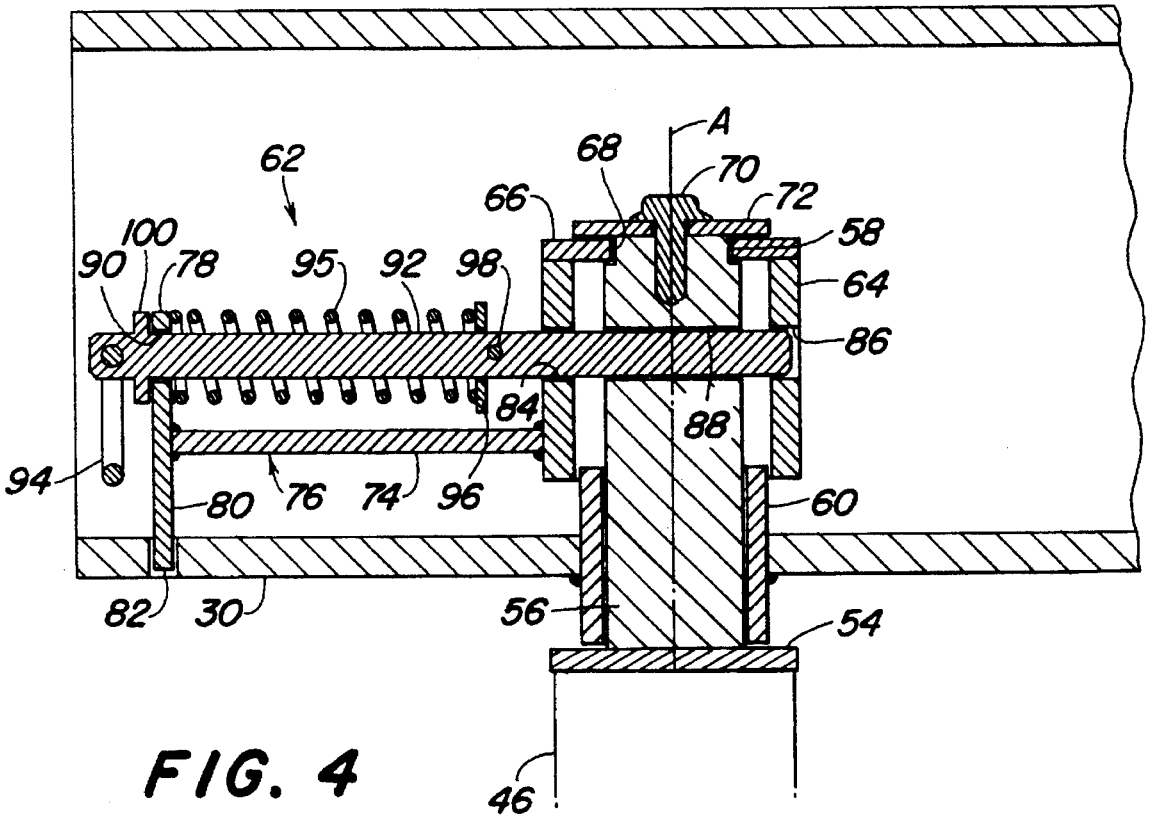
FIG. 4 is an enlarged vertical sectional view taken along line 4—4 of FIG. 3.

As can best be seen in FIGS. 3 and 4, each latch mechanism 62 includes a cylindrical collar 64 received on the upper portion of each of the pins 56. Welded to the top end of each collar 64 is a washer-like mounting member 66 containing a hole 68 receiving the boss 58. The mounting member 66 has a thickness which is slightly less than the height of the boss 58 and a cap screw 70, carrying a washer 72, is received in a threaded blind hole extending axially in the mounting pin 56 and is tightened against the top of the boss 58 without in any way loading the collar 64. Welded to a lower region of the collar 64 of the latch mechanism 62 is the inner end of a horizontally disposed stem 74 of a T-shaped latch pin mounting bracket 76. The T-shaped bracket 76 further includes a head having upper and lower portions 78 and 80, respectively, with the lower portion 80 extending into a hole 82 provided in the loader torque tube 30 so as to prevent the collar 64 from rotating about the connecting pin boss 58. The collar 64 is provided with diametrically opposite holes 84 and 86 that are axially aligned with each other and are parallel to a longitudinal axis of the torque tube 30. The mounting pin 56 of an associated stand 42 is provided with a cross hole 88 that is aligned with the holes 84 and 86 and with a hole 90 provided in the T-shaped bracket head upper portion 78. A latch pin 92, having a handle 94 at its outer end, is received in the aligned holes 84, 86, 88 and 90. Withdrawal of the latch pin 92 from the hole 86 and cross hole 88 is resiliently resisted by a coil compression spring 95 received on the pin 92 between the head upper portion 78 and a stop defined by a washer 96 received on the pin 92 and kept from moving away from the head portion 78 by a roll pin 98 received in a cross hole provided in the latch pin 92. Inward movement of the latch pin 92 is limited by a stop defined by a shoulder 100 carried by the pin and abutting the bracket head portion 78 when the pin 92 is in its latched position. Thus, the latch pin 92 selectively holds the stand in either its stored or park position as respectively shown in dashed and solid lines in FIG. 2.

It will be appreciated that when it is desired to move a stand 42 between its stored and parking positions it is necessary only to unlatch the latch pin 92 by withdrawing the latter from the cross hole 88 of the mounting pin 56 of the associated stand 42 and rotate the stand 180° it being noted that, once the cross hole 88 is moved from alignment with the latch pin 92, the latch pin may be released and when the mounting pin cross hole 88 again comes into alignment with the latch pin 92 the spring 95 will move the latch pin 92 to its latch position within the cross hole.

It is here noted that because the stand mounting receptacles 60 are disposed substantially vertically when the loader 12 is positioned, as shown in FIGS. 1 and 2, for being dismounted from the tractor 10 and parked or for being remounted on the tractor, any desired rotation of the stands 42 about the axes of their mounting pins 56 in disposing the stands in their respective park of stored positions involves only the effort it takes to overcome the friction between the mounting pins 56 and the receptacles 60. The only lifting that might be involved would be that to adjust the length of the stand 42 by sliding the relatively light inner tube 44 one way or the other within the outer tube 46.

The operation of the stand system 40 is thought to be apparent from the foregoing and for the sake of brevity is not repeated here.

We claim:

1. In a front end loader including a boom including a pair of parallel arms having their rear ends respectively pivotally mounted to upper ends of a pair of upright masts and having their respective forward ends pivotally attached to an implement, and a parking stand system including a pair of parking stands respectively mounted upwardly and rearwardly from the implement to a pair of transversely spaced locations of the boom, the improvement comprising: said parking stand system, as considered with the loader in a park attitude with the implement resting on the ground, including a pair of cylindrical mounting receptacles respectively fixed to said boom, in substantially vertical orientations, at said pair of locations; each of said pair of parking stands including a main leg portion located along a first axis and a connecting pin angled from said axis so as to define an included obtuse angle therewith; each connecting pin being received in a selected one of said mounting receptacles for movement between stored and park positions; and each stand including a releasably latch means for retaining its pin in said selected one of the receptacles and for selectively fixing each stand either in its stored or in its park position.

2. The loader defined in claim 1 wherein said pair of locations are respectively adjacent inner sides of said pair of arms; and said obtuse angle being chosen such that said main leg portions of the stands extend downwardly and forwardly toward said implement respectively from said pair of locations and respectively along side the pair of arms when the stands are in their respective stored positions.

3. The loader defined in claim 1 wherein said main leg portion of each stand includes upper and lower elongate components with the lower component being adjustable lengthwise relative to the upper component such that the main leg portion is length adjustable.

4. The loader defined in claim 1 wherein said loader includes a horizontal torque tube interconnecting said pair of parallel arms; and said cylindrical receptacles being fixed to said torque tube.

5. The loader defined in claim 4 wherein said cylindrical receptacles penetrate said torque tube; and said releasable latch means being located entirely within said torque tube.

6. The loader defined in claim 5 wherein said latch means of each stand includes a cylindrical collar received on each stand connecting pin and being provided with diametrically opposite holes; and said latch means of each stand further includes a cross hole provided in the connecting pin which is positioned for being aligned with the holes provided in the collar when the stand is in either its stored position or in its park position; and a latch pin being received in said aligned holes of said collar and cross hole of said connecting pin.

7. The loader defined in claim 6 wherein the connecting pin of each stand includes a reduced diameter upper end forming a cylindrical boss and contains a threaded hole located centrally in said boss; said releasable latch means of each stand further including a washer-like mounting member fixed to the top of the collar and containing a hole receiving said cylindrical boss of said connecting pin; and said mounting member having a thickness slightly less than a height dimension of said cylindrical boss; a screw being received in said threaded hole and carrying a washer having a diameter larger than said hole in the mounting member, whereby tightening of the screw results in said washer being clamped against the boss but not against the mounting member so as to permit the connecting pin to rotate relative to said collar when the latch pin is withdrawn from the cross hole in the connecting member.

8. The loader defined in claim 7 wherein said collar forms part of a latch pin support bracket; said bracket including a T-shaped member having a horizontal stem welded at its inner end to a lower region of said collar beneath said latch pin; said T-shaped member including a head having an upper portion provided with a hole slidably receiving said latch pin; a coil compression spring mounted on said latch pin between the head upper portion and a stop carried on the latch pin at a location between the head upper portion and said collar, whereby said latch pin may be withdrawn from the connecting pin cross hole against a biasing force exerted by said spring.

9. The loader defined in claim 8 wherein said torque tube is provided with an opening located in vertical alignment with said head of the T-shaped member; and said head of the T-shaped includes a lower portion received in said opening.

* * * * *